US005125727A

United States Patent [19]

Lechman et al.

[11] Patent Number: 5,125,727

[45] Date of Patent: Jun. 30, 1992

[54] ADJUSTABLE MONITOR SUPPORT ASSEMBLY

[75] Inventors: John N. Lechman; Thomas Wegman, both of Effingham, Ill.

[73] Assignee: Nova Office Furniture, Inc., Effingham, Ill.

[21] Appl. No.: 693,392

[22] Filed: Apr. 30, 1991

Related U.S. Application Data

[63] Continuation-in-part of Ser. No. 595,864, Oct. 11, 1990, abandoned.

[51] Int. Cl.[5] ..... A47B 17/02

[52] U.S. Cl. ..... 312/194; 108/110; 108/108; 211/119; 211/208

[58] Field of Search ..... 312/196; 108/107, 110, 108/116, 144; 211/113, 119, 187, 192, 208

[56] References Cited

U.S. PATENT DOCUMENTS

| | | | |
|---|---|---|---|
| 2,970,702 | 2/1961 | Maslow | 108/153 |
| 3,021,185 | 2/1962 | Kowalczyk . | |
| 4,590,866 | 5/1986 | Schairbaum | 108/23 |
| 4,755,009 | 7/1988 | Price et al. | 312/194 |
| 4,836,478 | 6/1989 | Sweere | 248/1 E |
| 5,071,204 | 12/1991 | Price et al. | 312/208 |

FOREIGN PATENT DOCUMENTS

| | | | |
|---|---|---|---|
| 1106895 | 8/1981 | Canada . | |
| 0560631 | 4/1975 | Switzerland | 108/107 |
| 659370A5 | 1/1987 | Switzerland . | |

*Primary Examiner*—Gerald A. Anderson
*Attorney, Agent, or Firm*—Olson & Hierl, Ltd.

[57] ABSTRACT

An improved adjustable assembly for supporting a monitor or the like under a transparent window portion of a desk top member or like structure. The assembly incorporates a shelf member which is supported at each lateral end thereof by a side support. The shelf member is preferably so supported by a locking block arrangement for each of a total of four supporting shaft members that outwardly extend from the shelf member. The position of the shelf member in relation to the side support is adjustable for height and tilting purposes. The shelf member and the side supports are formed of wire.

21 Claims, 5 Drawing Sheets

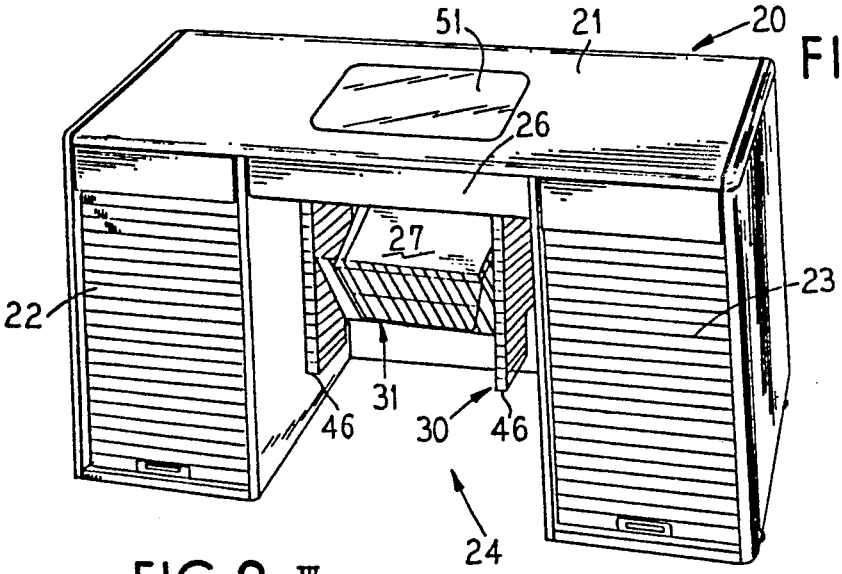
FIG. 1
FIG. 2
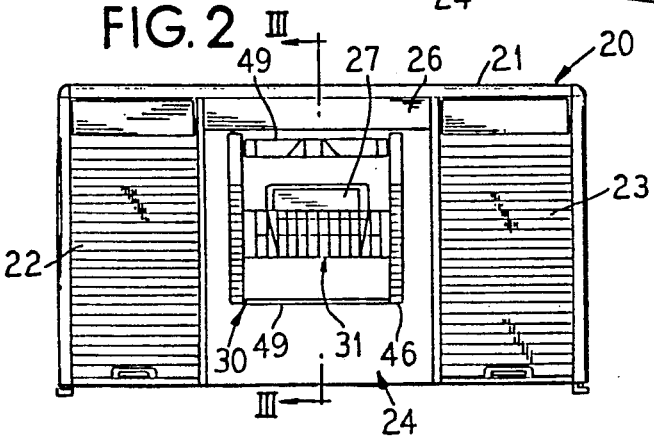
FIG. 3
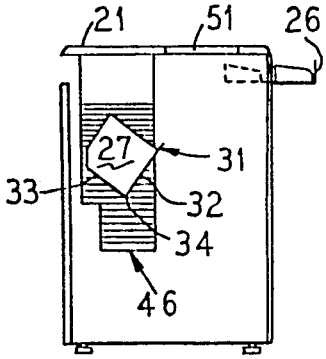
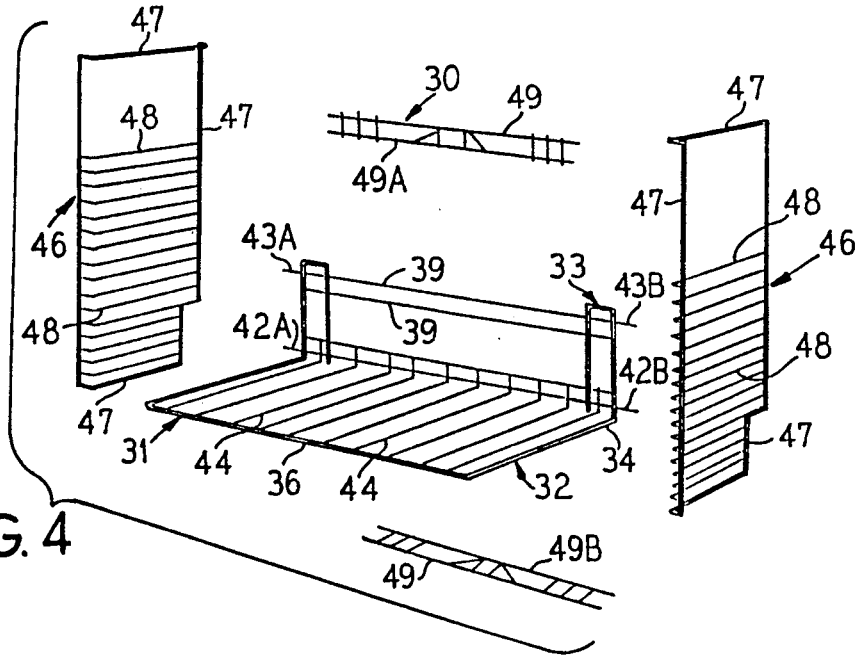
FIG. 4

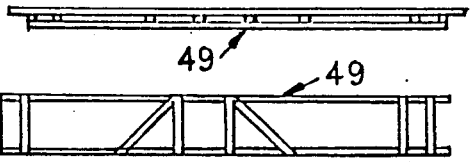
FIG. 5c
FIG. 5b
FIG. 5d
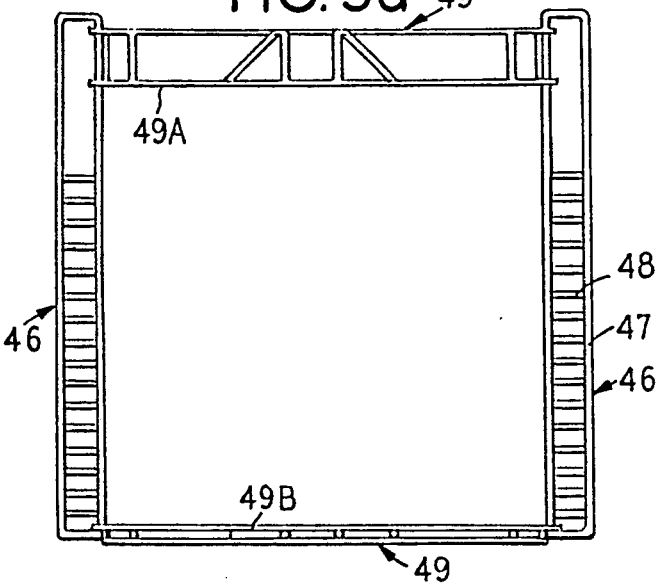
FIG. 5a
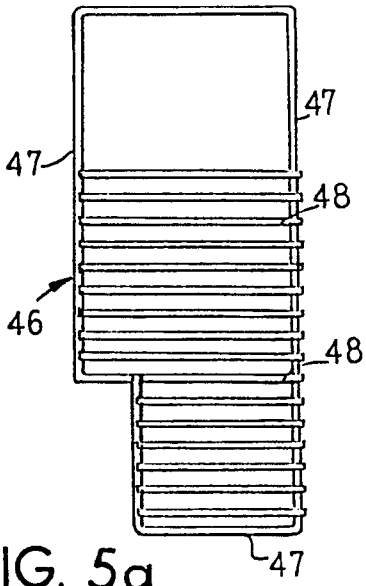
FIG. 5g
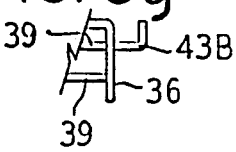
FIG. 5e
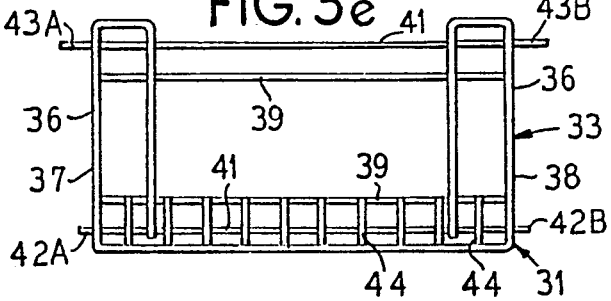
FIG. 5h
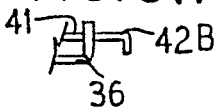
FIG. 5f
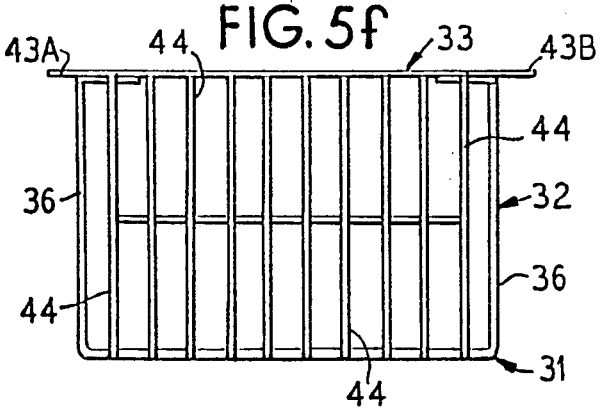

ADJUSTABLE MONITOR SUPPORT ASSEMBLY

RELATED APPLICATION

This application is a continuation-in-part of our U.S. Pat. Application Ser. No. 595,864, filed Oct. 11, 1990 now abandoned.

FIELD OF THE INVENTION

This invention relates to underdesk monitor support assemblies for desk structures and the like that have a transparent top portion through which a monitor can be viewed.

BACKGROUND OF THE INVENTION

When a desk or similar structure is provided with a top member that incorporates a transparent surface portion, it becomes possible to position a cathode ray tube (CRT) or monitor under the desk top surface for viewability through the transparent surface portion Such arrangements are shown, for example, in Schairbaum U.S. Pat. No. 4,590,866 and Price et al U.S. Pat. No 4,755,009.

Such a monitor is in operative and functional association with a central processing unit (CPU) which can be in the desk structure as shown in Price et al. or elsewhere as desired.

Because of the multiplicity of different desk structures and the like which can be equipped with a transparent top surface portion, there is a need in this new and developing art for a monitor support assembly that is adaptable for use in many different desk structures.

In addition, there is also a need in this art for a monitor support assembly which is adjustable as regards the tilt angle of a monitor supported thereby relative to the overlying transparent top surface portion so as to meet the needs of the individual use situation and the desires of the individual user.

There is a need in this art for an improved adjustable monitor support assembly which is adapted for use with a variety of desks and similar structures that are provided with a transparent surface portion. The assembly must also be adjustable to accommodate differing desired or needed spatial positions and orientations of a monitor supported therewith relative to the transparent surface portion. This invention provides such an assembly.

SUMMARY OF THE INVENTION

The present invention provides an adjustable assembly for supporting a monitor means or the like under a transparent surface portion of a desk or like structure. The present invention also provides combinations of such a desk or like structure with such an adjustable monitor support assembly.

In the adjustable monitor support assembly, a shelf member having a bottom support member and a upstanding back member is utilized. It is preferred that the bottom support member and the back member each be generally flat and at right angles to each other. The shelf member is vertically positionable and tiltably adjustable relative to a pair of side supports with one side support being located at each lateral side of the shelf member. These side supports are preferably each rectangularly configured and vertically oriented.

Each such side support can be spaced from the other thereof by a pair of interconnecting stringers which are themselves vertically spaced from each other. Each such side support is preferably suspended from a top portion of a desk structure so that interconnection with kneehole side walls or the like can be avoided, and so that the monitor support assembly can be used with many different desks or like structures. This allows the present invention to be used in a desk having any size of kneehole or even in a table which does not define a kneehole. It also allows for retrofitting of an existing structure.

The shelf member and the side supports can each be conveniently formed of interwelded heavy wire components which not only make the assembly light in total weight, but also make possible excellent capacity for air circulation for monitor cooling purposes.

Various means for securing the shelf member to the side supports can be used. Generally, two pairs of opposed shelf support means are provided on the shelf member to mount it on the side supports. The shelf supports are spaced from each other (e.g. front and back) to provide support for the shelf member. It is preferred that the shelf support means include preformed, inter-engaging mounting members which reversibly lock over portions of the side supports yet allow adjustable pivotable movement of the shelf member relative thereto as is desirable in assembly and adjustment of the shelf member relative to the side supports.

The present adjustable monitor assembly is believed to offer a substantial advance in the art of underdesk monitor supporting and to overcome various problems and limitations associated with prior art underdesk monitor mounting assemblies.

Other and further objects, aims, purposes, features, advantages, and the like will be apparent to those skilled in the art from the present specification taken with the accompanying drawings.

BRIEF DESCRIPTION OF THE DRAWINGS

In the accompanying drawings, which comprise a portion of this disclosure:

FIG. 1 is a perspective view of the monitor support assembly of the present invention mounted under a desk;

FIG. 2 is a front elevational view of the monitor support assembly and desk of FIG. 1;

FIG. 3 is a vertical sectional view taken along the line III—III of FIG. 2;

FIG. 4 is an exploded perspective view of the monitor support assembly;

FIG. 5*a* is an elevational view of a side support member of the embodiment shown in FIG. 4;

FIGS. 5*b* and 5*c* are elevational and top views, respectively, of a corresponding stringer member;

FIG. 5*d* is an elevational view of a pair of side support members connected by upper and lower stringer members;

FIGS. 5*e* and 5*f* are elevational and top views, respectively, of a monitor support shelf;

FIGS. 5*g* and 5*h* are partial elevational views of an alternative mounting means;

DETAILED DESCRIPTION

Figure 6:
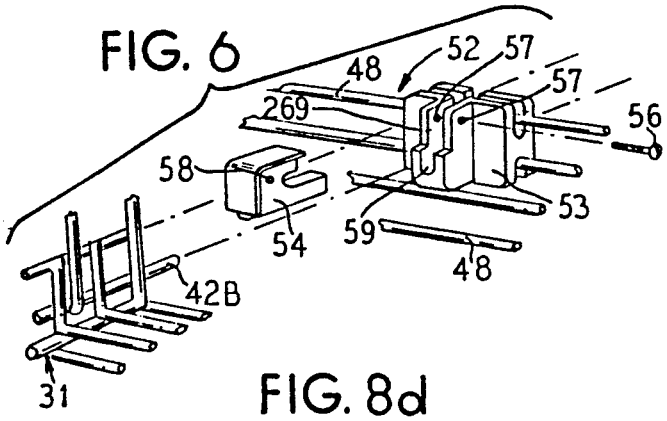
FIG. 6 is an exploded perspective view of one embodiment of a locking block assembly, such an assembly being the preferred mounting means for associating a monitor support shelf with a vertical side support member of a monitor support assembly.

Referring to the drawings, there is seen in FIGS. 1 and 2 an illustrative embodiment of a desk structure 20 that has a top flat surface member 21 supported by pair of longitudinally spaced pedestals 22 and 23 which define therebetween a kneehole 24. Under the surface member 21 across the kneehole 24 is a transversely short keyboard holding platform (not detailed) that is transversely slidable from the closed position shown to a fully extended position (see FIG. 3), the platform being provided with a front vertically mounted cover board 26. A CPU (not shown) can be housed within either pedestal 22 or 23, if desired. A monitor 27 (see FIG. 2) is positioned in an upper rear portion of the kneehole 24. The monitor 27 is functionally associated with a keyboard (not shown) and with a CPU, thereby to provide a complete word-processing station, or the like, as desired.

To so position monitor 27 in desk structure 20, an embodiment 30 of an adjustable monitor support assembly of this invention is utilized. Support assembly embodiment 30 utilizes a shelf member 31 having a flattened bottom support member 32 and a flattened back member 33 that integrally upstands or extends from a rear edge region 34 of bottom member 32.

Shelf member 31 is preferably comprised of formed heavy wire members which are interwelded together at points of contact therebetween. Thus, shelf member 31 incorporates a perimeter defining wire 36 which is folded (bent) upwards at rear edge 34, and, at each opposed lateral end edge 37 and 38, is also folded inwardly so as to provide added strength for back member 33 with two coplanar lengths of wire 36 being at each end edge 37 and 38 in the embodiment shown. Back member 33 is further provided, in such embodiment, with a pair of parallel, longitudinally extending, vertically spaced back member supporting wires 39, and also with a pair of parallel, longitudinally extending, vertically spaced, shelf supporting wires 41.

One of the wires 41 which is adjacent the rear edge portion 34 provides a first pair of opposed shelf support shafts 42A and 42B which extend laterally and longitudinally outwardly from the back member 33. The other one of the wires 41, which is spaced from the rear edge portion, but is preferably adjacent to the upper edge region of back member 33, provides a second pair of opposed shelf support shafts 43A and 43B which likewise extend laterally and longitudinally outwardly from the back member 33.

Alternatively or in addition, a further pair of opposed shelf supports (not shown) can be located on the forward portion of the bottom member 32. At least two pairs of shelf supports are used which need to be spaced apart from each other, but need not be located at particular parts of the shelf. A still further variation places a pair of shelf supports (not shown) on the forward portion of the bottom member with the other pair (not shown) on the upper edge region of the back member.

Also, the space between the lateral end edges of bottom member 32 is provided with a plurality of spaced, parallel, transversely extending, bottom member supporting wires 44 which, in the region of rear edge 34, are bent upwards and welded to at least one of each of wires 41 and 39, thereby to provide added rigidity for retaining the angular relationship between back member 33 and bottom member 32. Such rigidity is desirable because, in the preferred assembled support assembly 30, the bottom member 32 is cantilevered from back support member 33 and is not otherwise held or supported when a monitor 27 rests on bottom member 32. Thus, shelf member 31 is itself supported and held only by the respective opposed shelf support shafts 42 (paired) and 43 (paired).

Support assembly 30 further incorporates a pair (left and right mirror images of each other) of generally rectangularly configured side supports 46. Each is oriented vertically and is disposed at a different opposed lateral end edge of shelf member 31. Each of such side supports 46 is preferably formed of heavy wire. Thus, each is defined by a perimeter defining wire 47 which is folded (bent) inwardly to define a flange that extends along each transversely spaced front and rear edge of each such side support 46 for structural support and rigidity purposes. In the embodiment 30, and as shown in FIG. 4, for example, each side support 46 has a slot removed from the lower inside edge portion thereof for purposes of possibly accommodating a power cord or the like (not shown) that could perhaps be associated functionally with a monitor in a given installation. In addition, a plurality of horizontally extending, vertically spaced support member wires 48 are provided for each side support 46. Wires 48 are welded to respective wires 47 at each point of contact therebetween. The wires 48 thus provide a ladder-rung-like configuration which is utilized in the monitor support assembly 30 as shown and as described below.

A pair of stringers 49 is preferably also provided. One stringer 49A is positioned between the adjacent spaced upper edge portions of each one of the side supports 46. The other stringer 49B is positioned between the adjacent spaced lower edge portions of each one of the side supports 46. The opposite ends of each stringer are secured by mounting means (not shown) to contacting portions of each side support 46. Each stringer is formed by a pair of lengthwise extending perimeter wires with reinforcing and positioning wires extending therebetween, as shown, with welding at crossover locations. Any convenient such mounting means can be employed, including welding, hooks formed in the perimeter wires, and the like. A loose interconnection between stringers 49 and side supports 46 is convenient.

The shelf member 31 can be joined to each of the side supports 46 by any convenient means, as those skilled in the art will readily appreciate. Means is provided for adjustably mounting each individual one of the shaft means 42A and 43A to a different respective one of the rung members 48 in adjacent side supports 46, and similarly for each individual one of the shaft means 42B and 43B to the adjacent other one of the side supports 46.

The top edge portion of each side support 46, that is, a top portion of wire 47, is clamped by U-clamps, or the like, to a portion of a desk top or the like which is adjacent to the transparent portion, such as transparent portion or window 51 comprised of glass or the like in the surface member 21 of the desk structure 20. Thus, the assembly 30 is suspended from side supports 46 (paired) and no other clamping, laterally provided support means, or the like is needed or desired.

Hence, the support structure 30 of this invention is suspendable in a desired location under a desk or similar structure. The shelf member 31 is vertically adjustably positionable and also tiltably adjustably positionable relative to the side supports 46. The monitor 27 is thus supportable by the shelf member 31.

Figure 7:
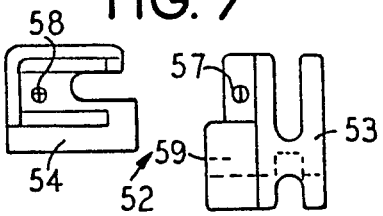
FIG. 7 is a side view of the principal components of the mounting means shown in FIG. 6.
Figure 8D:
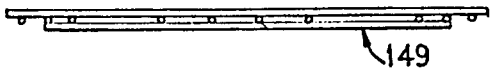
FIGS. 8*c* and 8*d* are elevational and top views, respectively, of a corresponding stringer member.
Figure 8C:
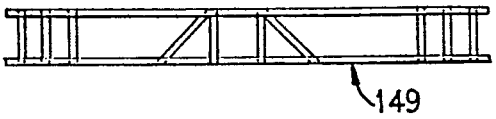
Figure 8A:
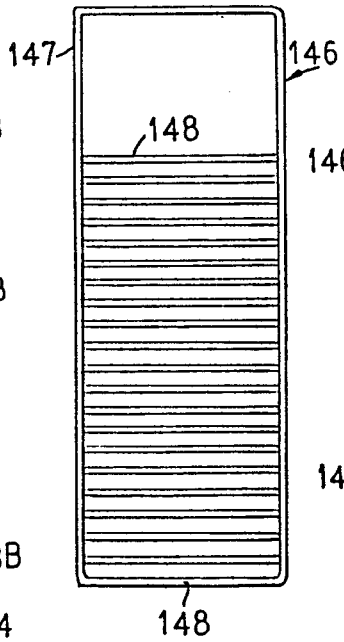
FIGS. 8*a* and 8*b* are elevational and side views, respectively, of a side support member for a second embodiment of the monitor support assembly.
Figure 8B:
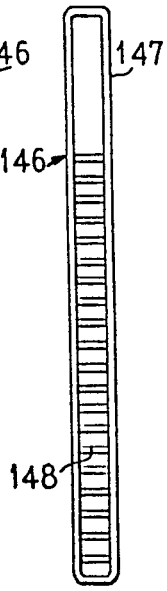
Figure 8E:
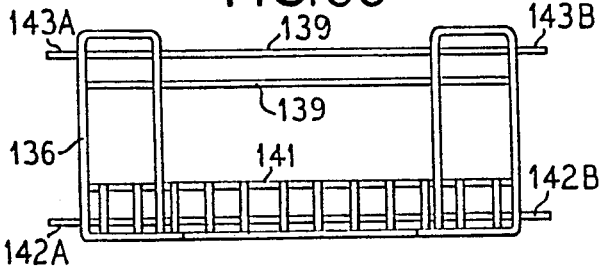
FIGS. 8*e* and 8*f* are elevational and top views, respectively, of a corresponding monitor support shelf adapted to receive a larger monitor.
Figure 8F:
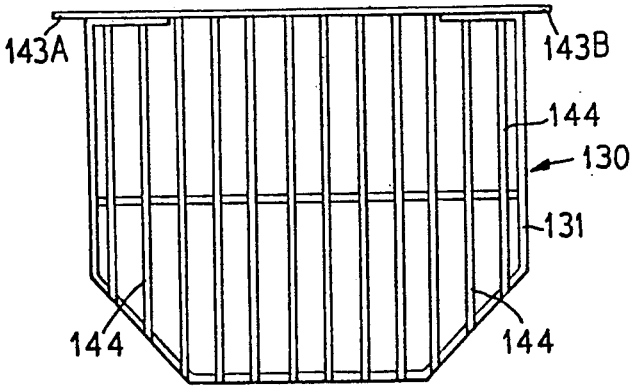
Figure 9:
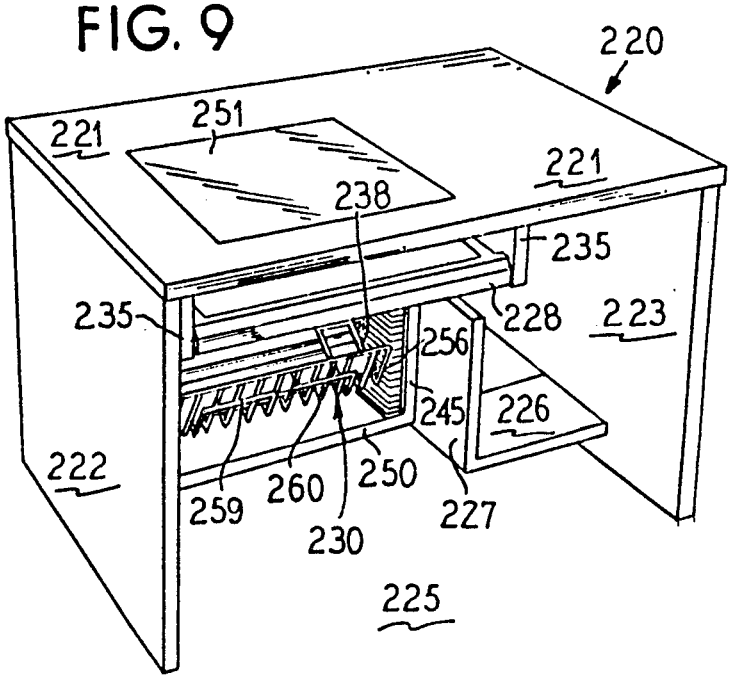
FIG. 9 is a perspective view of an alternative embodiment of the mon support assembly of the present invention mounted under a desk.
Figure 10:
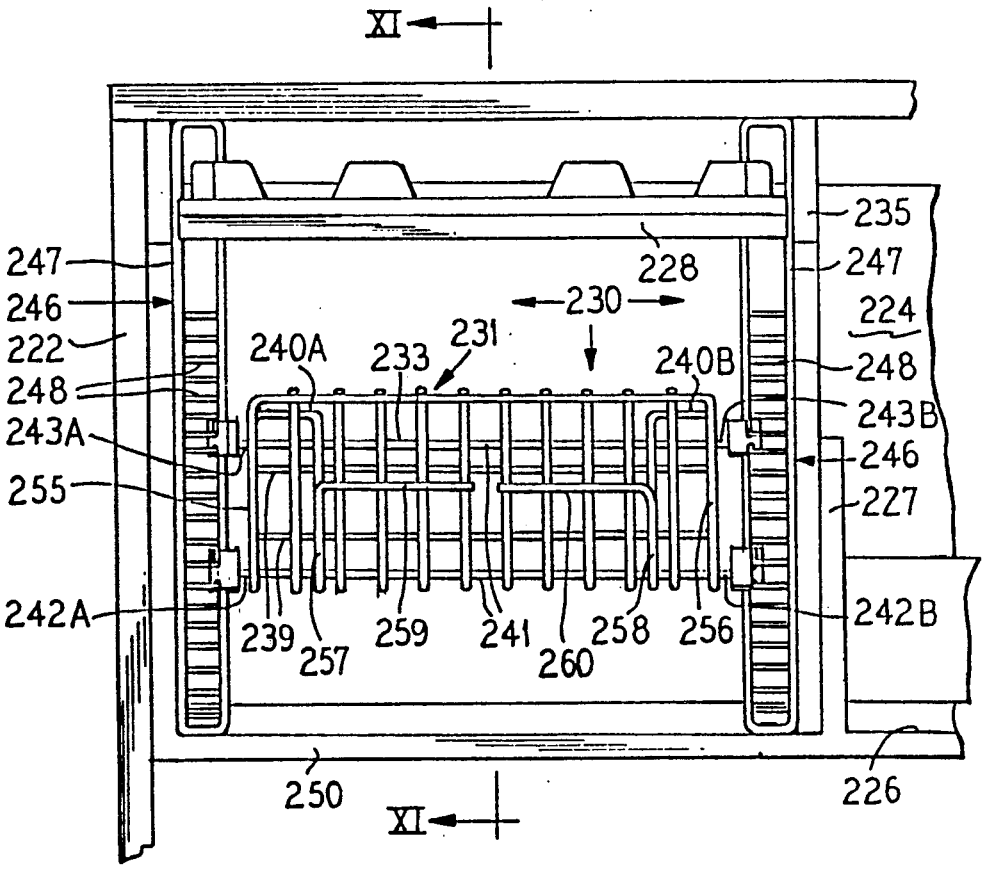
FIG. 10 is a front elevational view of the monitor support assembly and desk of FIG. 9 with the desk being shown fragmentarily.
Figure 13:
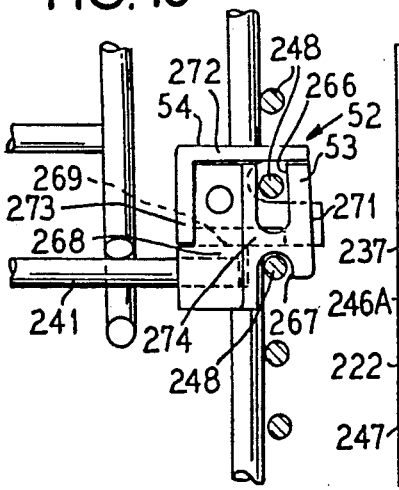
FIG. 13 is a fragmentary enlarged vertical sectional view taken along through the region XIII—XIII of FIG. 12 showing the assembled configuration of the locking block assembly of FIGS. 6 and 7.
Figure 12:
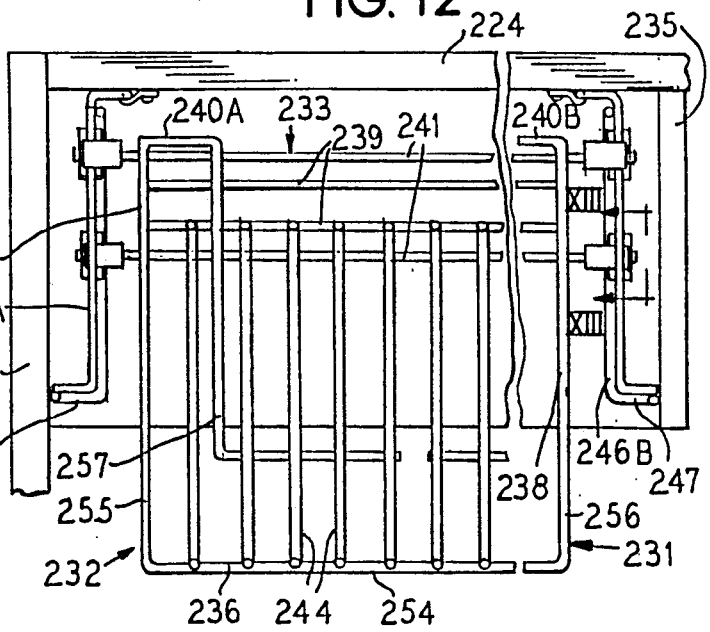
FIG. 12 a plan view of the monitor support assembly of FIGS. 9 and 10 with desk top components removed, and some parts thereof being broken away.

In a preferred mode of practicing this invention, the support shafts 42 (paired) and 43 (paired) are each adjustably positioned in place by a locking block assembly 52. Each such assembly 52, as shown in FIGS. 6, 7 and 13, utilizes two interengaging components, which can each be formed of injection molded plastic or the like, identified as rung block 53 and locking block 54.

In use, a rung block 53 is extended over a pair of adjacent rung wires 48. Thereafter, a locking block 54 is slidably fully engaged therewith within the limits of the molded engaging channels in blocks 53 and 54. Then, a pin or screw 56 is extended through the now aligned preformed holes 57 and 58, respectively, in blocks 53 and 54, thereby completing a locking engagement between blocks 53 and 54 with rung block 53 thus locked about two rung wires 48. After such a locking engagement is achieved, a channel 59 is provided whose diameter is suitable for accommodating a support shaft (that is, one of 42A, 42B, 43A, or 43B). In assembly, it is preferred to first position support shafts 42A and 42B and then to pivot the shelf member 31 relative thereto into a desired tilting orientation after which the shafts 43A and 43B are secured.

The present inventive wire form monitor support assembly has various features. Thus, for example:

a. It allows for under top mounting versus side mounting. This makes it more flexible to be used in a variety of applications and is not size dependent on the knee space opening.

b. Ventilation of the monitor is addressed. Most monitors have considerable air flow venting up through their base. By supporting a monitor on a flow through wire form support, this air flow is enhanced.

c. The wire form side supports have a narrow side profile. This helps to prevent bumping into the side support with ankles and shins of a person using an underdesk monitor.

d. The side support member has a built-in cut around to permit integration of a wire raceway extrusion into a desk design, thereby providing a more organized wire management approach versus merely stringing wires to keep them from becoming a tangled maze.

e. Height adjustability is achieved through locating the monitor support assembly at various height locations provided by side cross rails on the side supports. Angular adjustments are obtained by swiveling the bucket on its upper cross support and locating the lower cross support in the appropriate side rail.

A preferred element is a rail block with a locking block insert. This block assembly is used on all four corners of the shelf member. Each such block assembly engages onto a pair of the side support side rails or rungs. This block allows forward and back movement of the shelf member on side rails. It also provides a very desirable pivot lock.

Once in position, the block assembly is engaged and prevents the shelf member monitor support from being disengaged. Additionally, a fixing screw or pin is installed through the block for permanent engagement requiring tools for removal or further adjustment.

In another embodiment 130 of a monitor support assembly shown in FIGS. 8a-8f, an enlarged monitor support is provided to allow installation of oversize monitors, since a 20 inch monitor size is often used in so called C.A.D. equipment or other engineering related functions.

This embodiment 130 requires an extended front monitor bucket or shelf member 131. It also requires a pair of extended height side supports 146 to allow lower placement of such a larger monitor under the view glass, such as glass 51.

The side supports 146 can be used with the type of cantilever supported work surfaces commonly used in office panel system products. If desired, the side supports 146 can have an additional leveler foot (not shown) attached thereto to be used as a leg support under the work surface that now must have a cutout area. Such a cutout could weaken the work surface top and allow sagging. The side supports 146 could thus additionally be used to support a work surface in this area.

The function of the enlarged monitor supports 146 is virtually identical to the standard monitor side supports 46 except that the supports 146 can offer more vertical adjustment and allow the use of larger monitors.

Referring to FIGS. 9 through 13, there is seen another illustrative embodiment of an underdesk adjustable monitor support assembly 230 which is incorporated into a desk structure 220. The desk 220 has a flat top member 221 supported by a pair of side walls 222 and 223 and by a back wall 224 (see FIG. 11). The side walls 222 and 223 define therebetween a kneehole 225. Under the surface member 221 across the kneehole 225 is located a transversely short keyboard holding platform 228 that is transversely slidable from the closed position shown to a fully extended position (similar to that shown in FIG. 3) on opposed parallel rails (not shown), one such rail being mounted to an inside upper portion of wall 222, the other being mounted on a vertically disposed rail support panel 235 mounted to back wall 224 and top member 221. A CPU (not shown) can be placed on a shelf 226 that is supported between the side wall 223 and a vertically extending partition 227. An upper edge portion of partition 227 is mounted in overlapped relationship to a downwardly extending leg 245 from rail support panel 235. A monitor (not shown but see phantom outline in FIG. 11) is positioned in an upper rear position of kneehole 225 on monitor support assembly 230 and is functionally inter-associated with a keyboard (not shown) and the CPU by wires (not shown) to provide a complete word processing station, or the like, as desired. A shallow support shelf 250 extends across the back of kneehole 225 between side wall 222 and leg 245.

The adjustable monitor support assembly 230 is comprised of formed wire components that are interwelded together at locations of contact therebetween. Assembly 230 incorporates a shelf member 231 having a flattened bottom support member 232 and an integrally formed flattened back member 233 that upstands or extends unitarily from a rear edge region 234 of bottom member 232 (see FIG. 11, the relationship is similar to that in shelf member 31).

Thus, shelf member 231 incorporates a perimeter defining wire 236 which has a mid point located in the middle of the front edge 254 of bottom support member 232. To define each opposed lateral side edge 255 and 256, respectively, of bottom support 232, the wire 236 is bent at about 90 degrees relative to front edge 254 at each opposed end of front edge 254. To define each opposed lateral side edge 237 and 238, respectively, of back member 233, the wire 236 is again bent in two places, each bend being at rear edge and being at about 90 degrees relative to each lateral side edge 255 and 256, respectively, and also perpendicular relative to front edge 254. At the upper end of each opposed lateral side edge 237 and 238, the wire 236 is again bent, this time in two successive 90 degree turns, each such turn being in relatively closely spaced relationship to the other thereof, so as to produce a pair of short sections 240A and 240B therebetween which in effect together define the back upper end edge 240 of the back member 233. Such short sections 240A and 240B are preferably, as in the present embodiment of shelf 231, in spaced, parallel relationship to the front edge 254. Each such pair of successive 90 degree turns together with the sections 238A and 238B therebetween thus defines a generally U-shaped arrangement for wire 236 which provides strength for back member 233 and produces two lengths of the wire 236 that are in spaced, parallel, coplanar relationship to each other adjacent each lateral side edge 237 and 238, respectively.

At rear edge region, as one continues along the wire 236 in each direction from its mid-point, the wire 236 is once again bent at about a 90 degree angle at two locations, thereby to provide a pair of spaced, generally parallel lengths 257 and 258. These lengths 257 and 258 however, extend slightly out of parallel alignment (see FIG. 11) with the respective portions of the wire 236 that define each of the lateral side edges 237 and 238, respectively, so that the wire 236 can undergo a final 90 degree turn to produce a pair of terminal wire sections 259 and 260 therein that are in an aligned, opposed, generally coaxial relationship with one another. Sections 259 and 260 each provide a supportive function, as hereinafter explained.

Back member 233 is further provided in shelf member 231 with a pair of parallel, longitudinally extending, vertically spaced back member supporting wires 239 and also with a pair of parallel, longitudinally extending, vertically spaced, shelf-supporting wires 241.

One of the wires 241 which is adjacent the rear edge portion 234 provides at opposite end portions thereof a first pair of opposed shelf support shafts 242A and 242B which extend laterally and longitudinally outwardly from the back member 233. The other one of the wires 241 which is spaced from the rear edge portion 234, but which is preferably adjacent to a back edge 240 of back member 233, provides at its opposite end portions a second pair of opposed shelf support shafts 243A and 243B which likewise extend laterally and longitudinally outwardly from the back member 233.

Also, the space between the lateral end edges 255 and 256 of bottom member 232 is provided with a plurality of spaced, parallel, transversely extending, bottom member supporting wires 244 which extend beyond the rear edge 234, but which are bent upwards at rear edge 234. All wires 244 are welded to at least one of each of wires 241 and 239, as well as to the wire 236 along front edge 254, thereby to provide a support platform and to add to the rigidity desired for retaining the desired 90 degree angular relationship between back member 233 and bottom member 232. Such rigidity is desirable because, in the preferred assembled support assembly 230, the bottom member 232 is cantilevered from back support member 233 and is not otherwise held or supported when a monitor rests on bottom support member 232. To provide added rigidity for the platform portion of bottom 232, each of the wires 244 which contacts one of the sections 259 and 260 is welded thereto. Thus, shelf member 231 is itself supported and held along its opposite sides only by the respective opposed shelf support shafts 242 (paired) and 243 (paired).

Support assembly 230 further incorporates a pair (left and right mirror images of each other) of generally rectangularly configured side supports 246A and 246B. Each side support 246 is oriented generally vertically and is disposed at a different opposed lateral end edge of shelf member 231. Each of the side supports 246 is preferably formed of heavy wire. Thus, each is defined by a perimeter defining wire 247 which is folded (bent) inwardly to define a flange in each side support that extends outwardly relative to shelf member 231 along each transversely spaced front and rear edge of each side support 246 for structural support and rigidity purposes.

Figure 11:
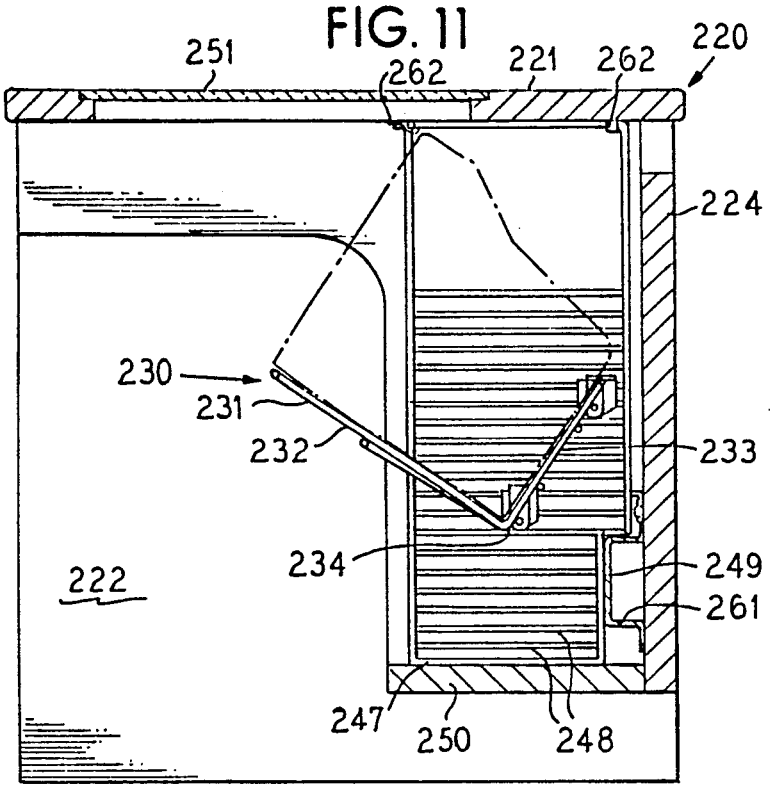
FIG. 11 is a transverse vertical sectional view taken generally along the line XI—XI of FIG. 10 with the position of a monitor being shown in phantom and with the keyboard platform removed.

In the embodiment 230, and as shown in FIG. 11, for example, each side support 246 has a slot 249 removed from the lower inside edge portion thereof for purposes of accommodating a channel housing 261 provided for power cords or the like running lengthwise across the inside of back wall 224 of desk 220, and from which, if desired, wires could extend out to be associated with a CPU on the shelf 226, a monitor on shelf 231, or the like. In addition, a plurality of horizontally extending, vertically generally equally spaced support wire members 248 are provided for each side support 246. Wires 248 are all welded to respective wires 247 at each point of contact therebetween. The wires 248 thus provide a ladder-rung-like configuration which is utilized in mounting and positioning a shelf member 232 in the monitor support assembly 230 as shown and as described herein.

The top edge portion of each side support 246, that is, a top portion of wire 247, is clamped by U-clamps 262, C-configured brackets, or the like, to an adjacent underside portion of desk top member 231 or the like such as portions which are adjacent to the transparent portion 251 that is comprised of glass or the like and that is inset into the surface member 221 of the desk structure 220. Also, the back edge wire portions of each side support 246 are similarly conveniently clamped against inside surface portions of back wall 244. In addition, the bottom edge wire portions of each side support 246 rest against adjacent surface portions of shelf 250. Hence, the support structure 230 is held in a desired location under a desk or similar structure.

The shelf member 231 is vertically adjustably positionable and also adjustably tiltably positionable relative to the side supports 246. A monitor is thus supportable and orientable by the shelf member 231. While the shelf member 231 can be joined to each of the side supports 246 by any convenient means, as those skilled in the art will readily appreciate, in a preferred mode of practicing this invention, each of the support shafts 242 (paired) and 243 (paired) is adjustably positioned and held in place by a locking block assembly 52, as above described. The appearance in side elevation of a positioned and interengaged assembly 52 of block 53 and locking block 54 is shown in FIG. 13.

Referring to FIGS. 6, 7 and 13, it is seen that in a locking block assembly 52, the rung block 53 and the locking block 54 are each comprised of a molded plastic, such as a polyolefin, a polyamide, a polyester or the like. Rung block 53 has a pair of generally vertically spaced (relative to a side support 246), parallel, longitudinally open support grooves 266 and 267 defined therein. Each support groove 266 and 267 extends completely through the rung block 53. Thus, grooves 266 and 267 are each engagable with a different adjacent one of each of two wires 248, such as shown in FIG. 13.

Also, rung block 53 includes a longitudinally open shelf groove 268 defined therein which extends perpendicularly relative to the support grooves 266 and 267. The shelf groove 268 terminates blindly in the interior of rung block means 53. Overlying and interconnected with the shelf groove is a locking channel 269 which extends completely through the rung block 53 and intersects with one groove 266.

The locking block 54 is provided with a block body 271 that slidably extends through the locking channel 269. Guidance means, here flanges 272, 273 and 274 on locking block 54 limit sliding movements of the block body 271 relative to the rung block 53. The block body 271 thus, when slidably fully engaged with the rung block 53, closes longitudinally the support grooves 266 and 267 and the shelf groove 268, and prevents separation from the assembled locking block assembly 52 of wires that are seated in the so closed grooves, such as wires 248 and 241 in FIG. 13.

Preferably a shelf member 31, 131 or 231, and the associated respective side supports 46, 146 or 246, are coated, by dipping or the like, with a layer of an elastomeric, and also electrically insulative, material, such as a layer derived from a polyvinylchloride plastisol, or the like. Such a coating layer is desirable for reasons of avoiding accidental physical impacts with a monitor and accidental current flow through a component of a monitor support assembly, as those skilled in the art will appreciate.

Various other and further embodiments, applications, structures and the like will be apparent to those skilled in the art from the teachings herein provided and no undue limitations are to be drawn therefrom.

What is claimed is:

1. An adjustable assembly for supporting monitor means under a transparent window portion of the top member of a desk, said adjustable assembly comprising in combination:

(a) a shelf member for supporting said monitor means, said shelf member having a bottom support member and an integral back support member extending transversely and angularly from a rear edge region of said bottom support member at a fixed angle relative to said bottom support member and said shelf member also having a pair of opposed, generally parallel lateral ends, said shelf member including first and second pairs of opposed shelf support members, each respective shelf support member of each of said first and second pairs laterally and outwardly extending in a transversely spaced relationship from a different one of said lateral ends, said members of said first pair extending from said back support member, and said members of said second pair extending from a location in the vicinity of said rear edge region of said bottom support member;

(b) a pair of independent side supports, each one being oriented vertically and disposed in spaced, parallel relationship relative to the other thereof and each being located along a different respective one of said opposed lateral ends, and each said side support having a plurality of vertically spaced load bearing members and also means for fastening each of said side supports to said desk in a stationary position;

(c) adjustable mounting means for clamping each of said first and said second pairs of opposed shelf support members to said load bearing members whereby said shelf member is suspendable in a desired location under said desk, said shelf member being vertically and tiltably adjustable relative to said side supports; and (d) each of said shelf member and said side supports being comprised of interwelded wire members; whereby said monitor member is adjustably supported by said shelf member at an inclined viewing angle through said transparent window portion of said desk.

2. The assembly of claim 1 wherein said load bearing members comprise wires.

3. The assembly of claim 1 wherein each member of said first and said second pairs of shelf support members comprises a wire support shaft.

4. The assembly of claim 1 wherein said shelf member includes perimeter wire means which defines edge portions thereof and reinforces said fixed angle.

5. The assembly of claim 1 wherein each of said adjustable mounting means comprises an interconnecting locking block means.

6. The assembly of claim 5 wherein each said locking block means comprises rung block means having a pair of generally vertically spaced, parallel, longitudinally open support grooves defined therein, each support groove extending through said rung block means and being slidably engagable with a different adjacent one of each of two of said load bearing members, and a longitudinally open shelf groove defined therein, said shelf groove extending perpendicularly relative to said support grooves and terminating blindly in said rung block means, and including an overlying locking channel relative to said shelf groove, said locking channel extending through said rung block means and intersecting one of said grooves; and locking block means having block means slidably extendable through said locking channel, and guidance means for limiting the sliding movement of said block means relative to said rung block means so that, when said locking block means is so engaged with said rung block means, said support grooves and said shelf groove are each closed and said locking block means is secured to wire means seated in said so closed grooves.

7. The assembly of claim 6 wherein said locking block means includes means for fixing said rung block means in association with said locking block means.

8. The assembly of claim 6 wherein said rung block means and said locking block means are each comprised of a unitary piece of molded plastic.

9. The assembly of claim 1 which is in functional association with said desk.

10. The assembly of claim 1 wherein said first and second pairs of shelf support members extend from said back support member.

11. The assembly of claim 1 wherein said first pair of shelf support members extends from an upper edge region of said back support member.

12. An adjustable assembly for supporting monitor means under a transparent surface portion of a desk comprising in combination:

(a) a shelf member for supporting said monitor means, said shelf member having a bottom support member and an integral back support member transversely and angularly extending from a rear edge region of said bottom support member and said shelf member also having a pair of opposed generally parallel lateral ends;

(b) a first pair of opposed self support members, each member laterally and outwardly extending from a different respective one of said lateral ends of said back support member;

(c) a second pair of opposed shelf support members, each member laterally and outwardly extending from a different respective one of said lateral ends in said rear edge region of said bottom support member and being transversely spaced from each adjacent one of said first pair of opposed self support member;

(d) a pair of independent side supports, each one being oriented substantially vertically and being disposed along a different one of said lateral ends;

(e) each one of said side supports having a plurality of vertically spaced generally parallel support members;

(f) means for adjustably mounting said shelf member by attaching said first and second pairs of shelf support members to respective adjacent ones of said parallel support members;

(g) suspending means for positioning and attaching each one of said pair of side supports in a stationary position to a portion of said desk so that said shelf member is positionable in an adjacent relationship to said transparent surface portion;

(h) each of said shelf member and said side supports being comprised of interwelded wire components; whereby said assembly is suspendable in a desired location under said desk, said shelf member being vertically and tiltably adjustable relative to said side supports, and said monitor means being supportable by said shelf member for viewing through said transparent window portion.

13. The assembly of claim 12 wherein each member of said first and second pairs of shelf support members comprises a wire support shaft.

14. The assembly of claim 12 wherein each of said means for adjustably mounting each individual one of said first and second shelf support members comprises an interconnecting locking block means.

15. The assembly of claim 14 wherein each said locking block means comprises rung block means having a pair of generally vertically spaced, parallel, longitudinally open support grooves defined therein, each support groove extending through said rung block means and being slidably engageable with a different adjacent one of each of two of said load bearing members, and a longitudinally open shelf groove defined therein, said shelf groove extending perpendicularly relative to said support grooves and terminating blindly in said rung block means, and including an overlying locking channel relative to said shelf groove, said locking channel extending through said rung block means and intersecting one of said grooves; and locking block means having block means slidably extendable through said locking channel, and guidance means for limiting the sliding movement of said block means relative to said rung block means so that, when said locking block means is so engaged with said rung block means, said support grooves and said shelf groove are each closed and said locking block means is secured to wire means seated in said so closed grooves.

16. The assembly of claim 15 wherein said locking block means includes means for fixing said rung block means in association with said locking block means.

17. The assembly of claim 15 wherein said rung block means and said locking block means are each comprised of a unitary piece of molded plastic.

18. The assembly of claim 12 wherein said shelf member includes perimeter wire means which defines edge portions thereof and maintains said bottom support member at a fixed angle relative to said back member.

19. The assembly of claim 12 which is in functional association with said desk.

20. The assembly of claim 12 wherein said first and second pairs of shelf support members extend from said back support member.

21. The assembly of claim 12 wherein said first pair of shelf support members extends from said bottom support member and said second pair of shelf support members extends from said back support member.

* * * * *

UNITED STATES PATENT AND TRADEMARK OFFICE

CERTIFICATE OF CORRECTION

PATENT NO. : 5,125,727

DATED : June 30, 1992

INVENTOR(S) : John N. Lechman and Thomas Wegman

It is certified that error appears in the above-identified patent and that said Letters Patent is hereby corrected as shown below:

Column 1, line 20, after "portion" insert --.--.

Column 1, line 22, after "et al" insert --.--.

Column 3, line 10, delete "mon" and insert --monitor--.

Column 5, line 64, change "cut around" to --cut-around--.

Column 7, line 1, change "word processing" to --word-processing--.

Column 7, line 2, change "shallow support" to --shallow-support--.

Column 10, line 33, delete "monitor member" and insert --monitor means--.

Column 11, line 39, change "member" to --members--.

UNITED STATES PATENT AND TRADEMARK OFFICE

CERTIFICATE OF CORRECTION

PATENT NO. : 5,125,727

DATED : June 30, 1992

INVENTOR(S) : John N. Lechman and Thomas Wegman

It is certified that error appears in the above-indentified patent and that said Letters Patent is hereby corrected as shown below:

Column 12, line 53, cancel beginning with "21. The assembly of" to and including "said back support member." in line 56, and insert the following claim:

--21. The assembly of claim 12 wherein said first pair of shelf support members extends from an upper edge region of said back support member.--.

Signed and Sealed this

Fourteenth Day of September, 1993

Bruce Lehman

*Attest:*

BRUCE LEHMAN

*Attesting Officer*

*Commissioner of Patents and Trademarks*